US006220332B1

(12) United States Patent
Lai

(10) Patent No.: US 6,220,332 B1
(45) Date of Patent: Apr. 24, 2001

(54) DOOR ASSEMBLY FOR SPANNING AN ENTRANCE OF A SHOWER ROOM

(76) Inventor: Sheng-Yang Lai, No. 24, Kai-Fa-Erh Rd., Pao-An Tsun, Jen-Te Hsiang,Tainan Hsien (TW)

( * ) Notice: Subject to any disclaimer, the term of this patent is extended or adjusted under 35 U.S.C. 154(b) by 0 days.

(21) Appl. No.: 09/455,587

(22) Filed: Dec. 6, 1999

(51) Int. Cl.[7] ..... E05D 15/26
(52) U.S. Cl. ..... 160/199; 160/235
(58) Field of Search ..... 160/118, 117, 160/196.1, 199, 185, 186, 187, 201, 206, 210, 213, 235, 183; 4/557, 558, 607, 608, 610

(56) References Cited

U.S. PATENT DOCUMENTS 2,770,298 * 11/1956 Hiatt ..... 160/199 X
2,885,000 * 5/1959 Merrill ..... 160/199 X
3,277,950 * 10/1966 Stouffer ..... 160/199 X
3,331,427 * 7/1967 Colombo ..... 160/199
3,720,255 * 3/1973 Ueda ..... 160/199
4,386,645 * 6/1983 Dever et al. ..... 160/235 X

* cited by examiner

*Primary Examiner*—David M. Purol
(74) *Attorney, Agent, or Firm*—Ladas & Parry

(57) ABSTRACT

A door assembly for spanning an entrance of a shower room includes an elongated rail member formed with a longitudinally extending slide channel, and a foldable sliding door unit which includes a plurality of vertically disposed elongated connectors, a plurality of vertically disposed elongated slats, and a plurality of slidable coupling units. Each of the connectors is formed with longitudinally extending left and right engaging grooves. Each of the slats has two lateral end portions which are formed respectively with vertically extending cylindrical members which are received in an adjacent pair of the engaging grooves of an adjacent pair of the connectors such that the cylindrical members are rotatable axially for folding and unfolding of the slats relative to the adjacent pair of the connectors. The slidable coupling units are mounted on upper ends of selected ones of the connectors, and extend into and are slidable along the slide channel so as to permit movement of the door unit to an unfolded state to close the entrance to the room, and so as to permit movement of the door unit to a folded state to open the entrance to the room.

20 Claims, 5 Drawing Sheets

DOOR ASSEMBLY FOR SPANNING AN ENTRANCE OF A SHOWER ROOM

BACKGROUND OF THE INVENTION

1. Field of the Invention

The present invention relates to a foldable door assembly which is used for spanning an entrance of a room, such as a shower room, which can be produced at a relatively low cost, and which does not require a large amount of operating space when in use.

2. Description of the Related Art

Conventionally, a shower curtain is commonly installed in a bathroom around a shower space and above a bathtub such that water can be prevented from wetting the ground surface of the bathroom outside the shower space. When the shower space is not in use, the shower curtain is moved toward an adjacent wall and is usually kept in a folded state such that different parts of the shower curtain are in close contact. As such, water on the surface of the shower curtain cannot easily evaporate therefrom, thereby often resulting in mildewing of the shower curtain.

A hinged door has been suggested heretofore for closing and opening an entrance to the shower room. However, operation of the hinged door requires a relatively large amount of space. The hinged door is found to be not suitable for use in a relatively cramped space.

Another kind of door that has been suggested for a shower room includes a parallel pair of vertical glass panels which are slidable along adjacent and parallel railways. When one of the glass panels is slid to one side of the other one of the glass panels, an entrance generally as wide as the panels is formed. As such, the width of the entrance is limited to the width of the panels, and can be enlarged only by broadening the space of the shower room.

In addition, installation of the aforementioned doors involves relatively complicated techniques, and can hardly be accomplished by the consumer. Additional costs for installation are thus incurred.

SUMMARY OF THE INVENTION

Therefore, the object of the present invention is to provide a door assembly which can be operated without the need for a large amount of space, which can be produced at a relatively low cost, and which can be easily assembled by the consumer.

Accordingly, the door assembly of the present invention is adapted for spanning an entrance of a shower room having first and second upright walls that extend upwardly from a horizontal ground surface. The door assembly includes an elongated rail member, and a foldable sliding door unit. The rail member is adapted to be disposed horizontally between the first and second upright walls and to be spaced apart vertically from the ground surface. The rail member is formed with a longitudinally extending slide channel. The foldable sliding door unit includes a plurality of vertically disposed elongated connectors, connector mounting means, a plurality of vertically disposed elongated slats, and a plurality of slidable coupling units. Each of the connectors has an upper end to be disposed adjacent to the rail member, and a lower end to be disposed adjacent to the ground surface. Each of the connectors further has left and right sides formed with longitudinally extending left and right engaging grooves. A first one of the connectors is located at one end of the door unit and is to be disposed adjacent to the first upright wall. A second one of the connectors is located at the other end of the door unit. The connector mounting means is adapted for mounting the first one of the connectors on the first upright wall. Each of the slats has two lateral end portions which are formed respectively with vertically extending cylindrical members which are received in an adjacent pair of the engaging grooves of an adjacent pair of the connectors such that the cylindrical members are rotatable axially for folding and unfolding of the slats relative to the adjacent pair of the connectors. Each of the slats has an upper edge adjacent to the upper ends of the connectors, and a lower edge adjacent to the lower ends of the connectors. The slidable coupling units are mounted on the upper ends of selected ones of the connectors, and extend into and are slidable along the slide channel so as to permit movement of the door unit toward the second upright wall to an unfolded state, where the connectors and the slats are disposed on substantially the same vertical plane to close the entrance to the room, and so as to permit movement of the door unit away from the second upright wall to a folded state, where the connectors and the slats cease to be disposed on substantially the same vertical plane to open the entrance to the room.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
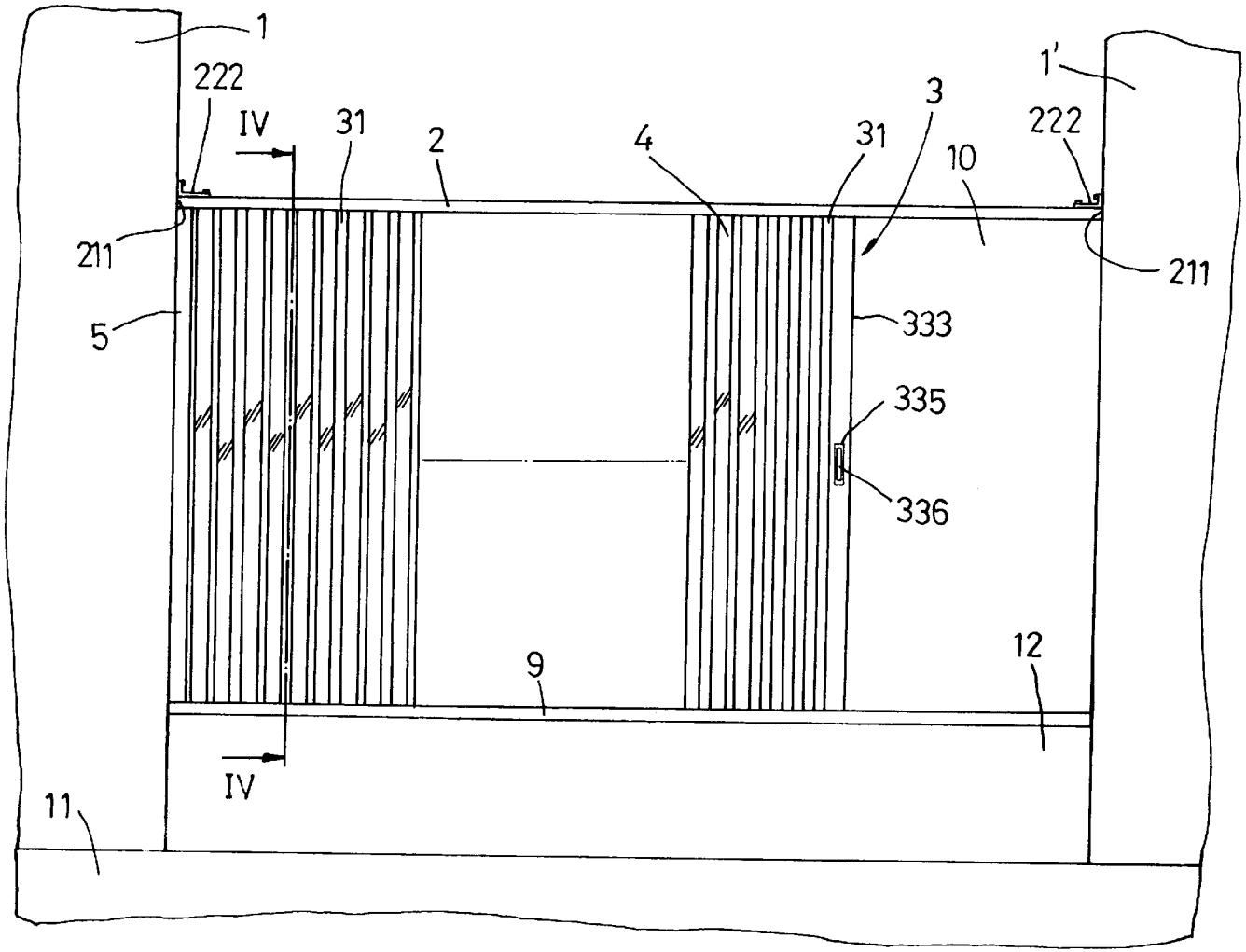
FIG. 1 is an elevational view of a preferred embodiment of a door assembly of the present invention.
Figure 2:
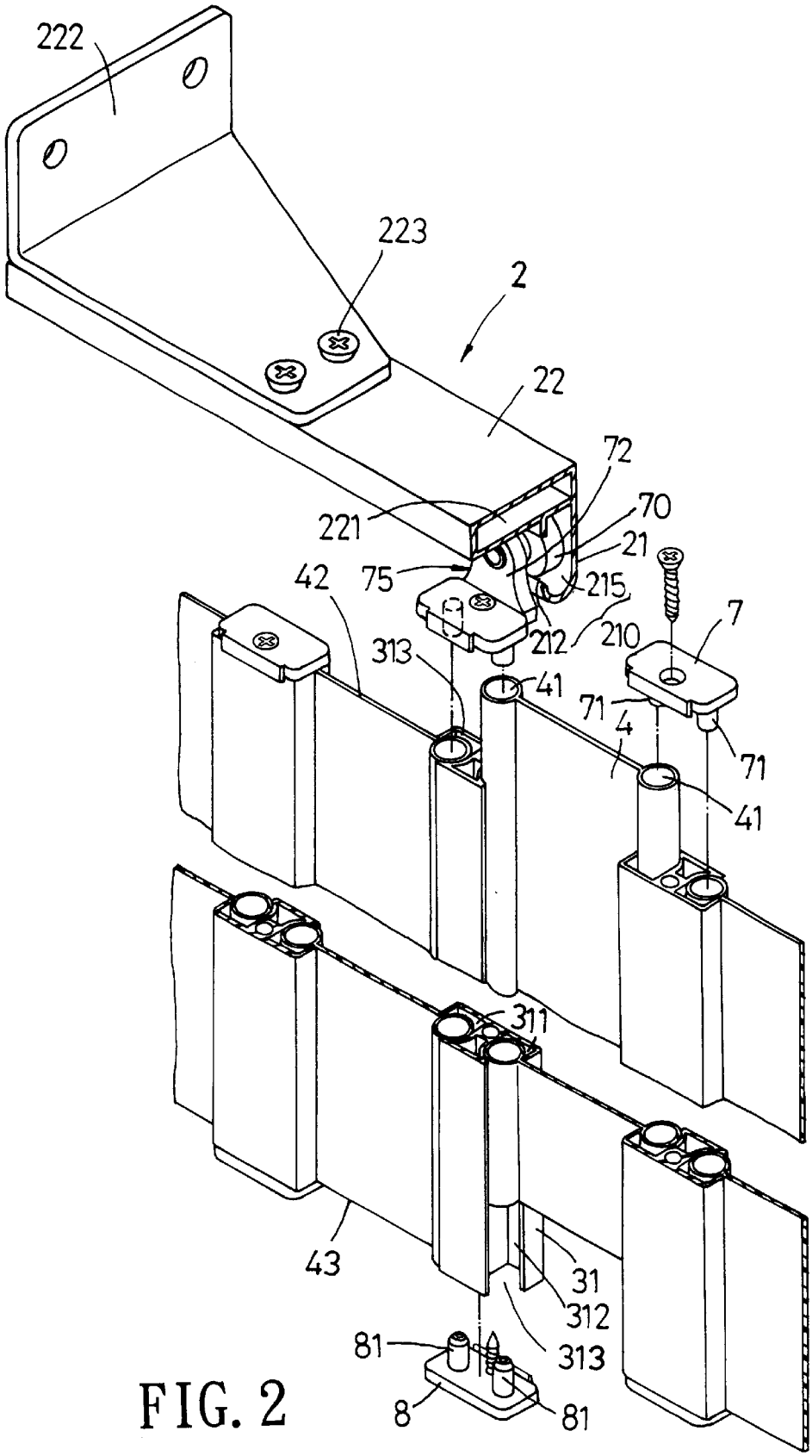
FIG. 2 is a fragmentary exploded perspective view of the preferred embodiment.

Referring to FIGS. 1 and 2, the preferred embodiment of the door assembly of the present invention is adapted for spanning an entrance 10 of a shower room having first and second upright walls 1, 1' that extend upwardly from a horizontal ground surface 11. The ground surface 11 has a raised portion 12 that extends between the upright walls 1, 1'. The door assembly is shown to generally include an elongated rail member 2, a foldable sliding door unit 3, and an elongated bottom guard member 9.

The rail member 2 is made of aluminum, and is adapted to be disposed horizontally between the first and second upright walls 1, 1', and to be spaced apart vertically from the raised portion 12 on the ground surface 11. The rail member 2 includes a hollow top portion 22 formed with a longitudinally extending first insert groove 221, and a hollow downward extension 21 which extends downwardly from the top portion 22. The top portion 22 of the rail member 2 has two opposite ends adapted to be fastened respectively to the first and second upright walls 1, 1' by means of a pair of L-shaped mounting plates 222 and a plurality of screw fasteners 223. The downward extension 21 is formed with a longitudinally extending slide channel 210 which has opposite open ends 211 disposed adjacent to the opposite ends of the top portion 22. The slide channel 210 includes a longitudinally extending roller accommodating portion 215, and a longitudinally extending axle slot 212 that is communicated with the roller accommodating portion 215 and that is narrower than the roller accommodating portion 215. The slot 212 is formed in one side of the rail member 2.

The sliding door unit 3 includes a plurality of vertically disposed elongated connectors 31, a plurality of vertically disposed elongated slats 4, a plurality of slidable coupling units 75, and a plurality of upper and lower caps 7, 8.

The connectors 31 are made from a plastic material. Each of the connectors 31 has an upper end to be disposed adjacent to the rail member 2, and a lower end to be disposed near the raised portion 12 on the ground surface 11. Each of the connectors 31 further has left and right sides formed with longitudinally extending left and right engaging grooves 311, and longitudinally extending slots 312 communicated respectively with the engaging grooves 311. The upper and lower ends of each of the connectors 31 are formed with upper and lower access openings 313 for access to the engaging grooves 311. The slots 312 in an adjacent pair of the connectors 31 are formed on opposite front and rear sides of the door unit 3.

The slats 4 are made of a plastic material, and are disposed between adjacent pairs of the connectors 31. Each of the slats 4 has two lateral end portions which are formed respectively with vertically extending cylindrical members 41. The cylindrical members 41 are to be received in an adjacent pair of the engaging grooves 311 of an adjacent pair of the connectors 31 such that the cylindrical members 41 are rotatable axially for folding and unfolding of the slats 4 relative to the adjacent pair of the connectors 31. The cylindrical members 41 are tubular in shape with open top and bottom ends. Each of the slats 4 has an upper edge 42 to be disposed adjacent to the upper ends of the connectors 31, and a lower edge 43 to be disposed adjacent to the lower ends of the connectors 31.

Figure 3:
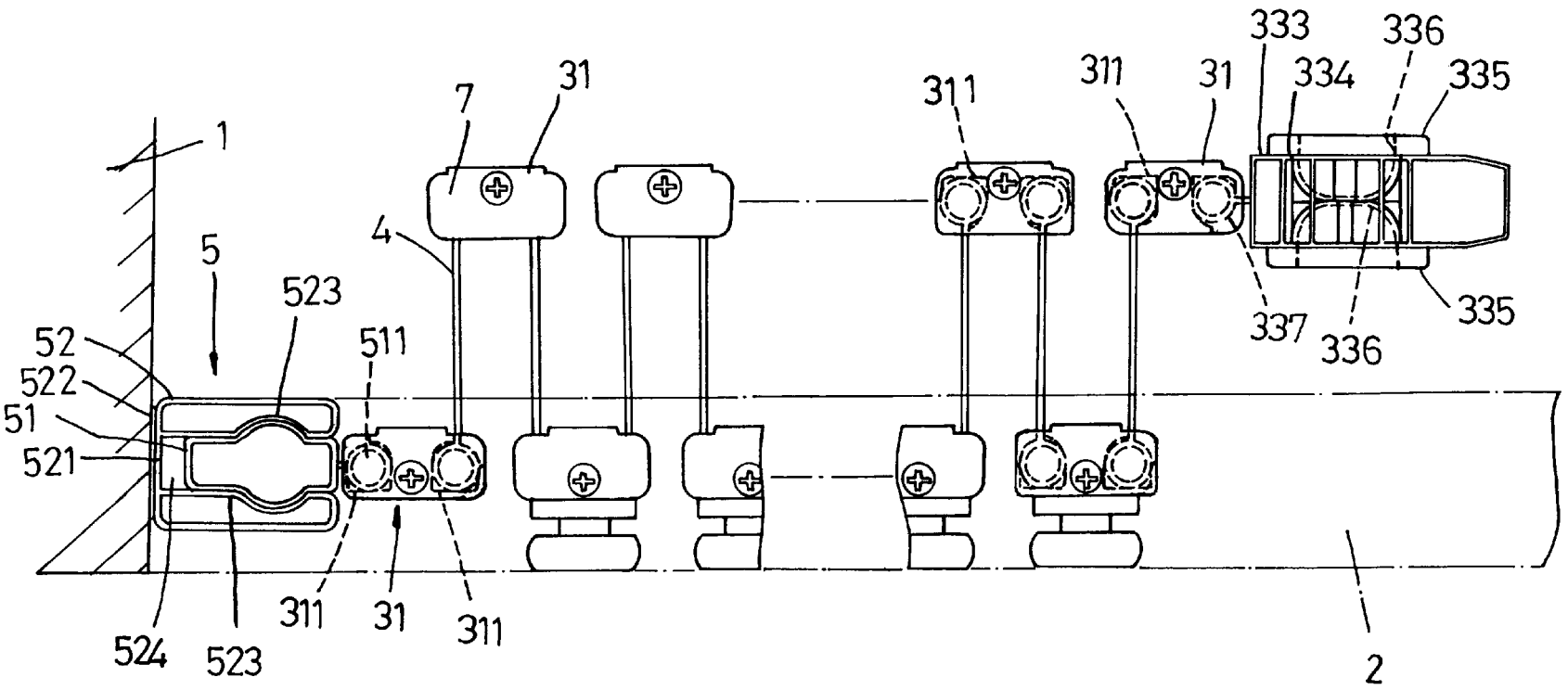
FIG. 3 is a top view illustrating the preferred embodiment when a sliding door unit is moved to a folded state.

Referring to FIG. 3, a first one of the connectors 31 is located at one end of the door unit 3 and is to be disposed adjacent to the first upright wall 1. The first one of the connectors 31 is adapted to be mounted on the first upright wall 1 by connector mounting means 5 which includes an outer frame member 52 and an inner frame member 51. The outer frame member 52 has spaced-apart front and rear clamping portions 523, and a bridging portion 521 which interconnects edge portions of the front and rear clamping portions 523 and which is adapted to be attached to the first upright wall 1 by means of a double-sided adhesive tape 522. The front and rear clamping portions 523 have confronting concave faces, and cooperatively define a clamping space 524 therebetween. The inner frame member 51 is clamped within the clamping space 524, and has convex front and rear sides for engaging the concave faces of the front and rear clamping portions 523 of the outer frame member 52. The inner frame member 51 has one end which is distal to the bridging portion 521 of the outer frame member 52 and which is provided with a vertically extending tubular member 511. The tubular member 511 is disposed outside of the clamping space 524, and is received in an adjacent one of the engaging grooves 311 in the first one of the connectors 31.

A second one of the connectors 31 is located at the other end of the door unit 3 opposite to the first upright wall 1, and has an operating frame member 333 mounted thereon. The operating frame member 333 has a tubular member 337 received in an adjacent one of the engaging grooves 311 in the second one of the connectors 31, and is formed with a rectangular mounting hole 334 which is provided with front and rear plate members 335 that engage each other. The plate members 335 are formed respectively with finger grooves 336 on front and rear sides of the operating frame member 333 to permit extension of fingers of a user thereinto to facilitate handling of the operating frame member 333.

Figure 4:
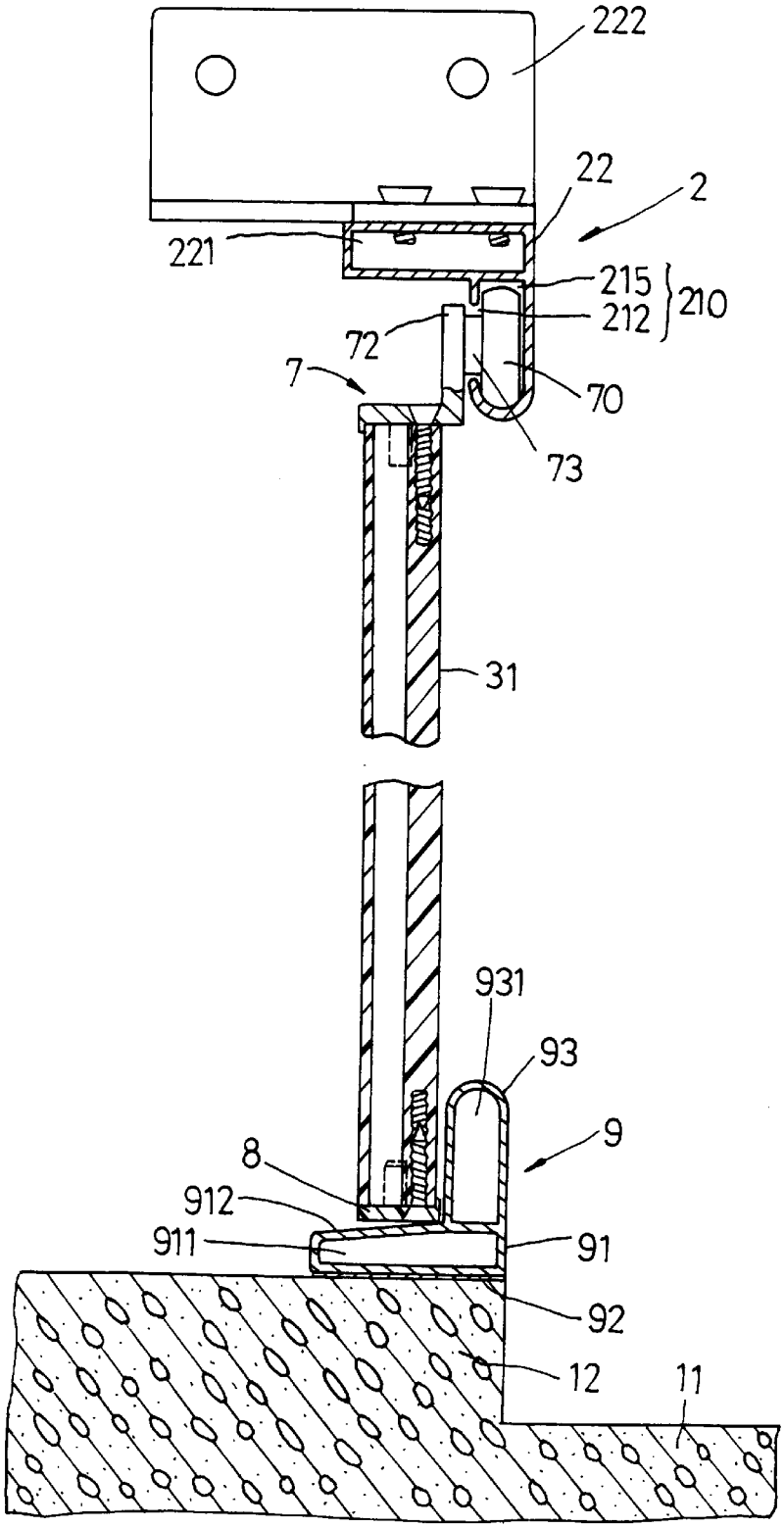
FIG. 4 is a sectional view of the preferred embodiment, taken along line IV—IV of FIG. 1.

Referring to FIGS. 2 to 4, the upper caps 7 are fastened to the upper ends of the connectors 31 with the use of screw fasteners. Each of the upper caps 7 is formed with a pair of positioning posts 71 which extend into the open top ends of the cylindrical members 41 that are received in the engaging grooves 311 of the respective one of the connectors 31. Similarly, the lower caps 8 are fastened to the lower ends of the connectors 31 with the use of screw fasteners. Each of the lower caps 8 is formed with a pair of positioning posts 81 which extend into the open bottom ends of the cylindrical members 41 that are received in the engaging grooves 311 of the respective connector 31.

The slidable coupling units 75 are provided on some of the upper caps 7, preferably on alternating ones of the upper caps 7. Each of the slidable coupling units 75 includes a roller 70 disposed in the roller accommodating portion 215 of the slide channel 210, a horizontal axle 73 having a first end portion connected to the roller 70 and a second end portion that extends out of the roller accommodating portion 215 via the axle slot 212, and a vertically extending axle support 72 which has an upper end connected to the second end portion of the axle 73 and a lower end connected to the respective upper cap 7. The slidable coupling units 75 are slidable along the slide channel 210 so as to permit movement of the sliding door unit 3 toward the second upright wall 1' (see FIG. 1) to an unfolded state, where the connectors 31 and the slats 4 are disposed on substantially the same vertical plane, as shown in FIG. 2, to close the entrance 10 (see FIG. 1) to the shower room, and so as to permit movement of the sliding door unit 3 away from the second upright wall 1' (see FIG. 1) to a folded state, where the connectors 31 and the slats 4 cease to be disposed on substantially the same vertical plane, as shown in FIG. 3, to open the entrance to the shower room. As shown, when the sliding door unit 3 is in the folded state, the slats 4 are disposed parallel to one another such that the length of the sliding door unit 3 measured between the first and second one of the connectors 31 along the longitudinal direction of the rail member 2 is relatively short to provide the entrance to the shower room with a relatively large width.

Referring to FIGS. 1 and 4, the bottom guard member 9 is made of aluminum, and is adapted to be disposed on the raised portion 12 of the ground surface 11, and to be disposed horizontally between the first and second upright walls 1, 1'. The bottom guard member 9 includes a longitudinally extending base portion 91 that is disposed immediately below the lower edges 43 of the slats 4 and the lower caps 8 mounted on the lower ends of the connectors 31 and that is adapted to be attached to the raised portion 12 of the ground surface 11 by means of a double-sided adhesive tape 92, and a longitudinally extending barrier 93 that extends upwardly from the base portion 91 and that is disposed on one side of the door unit 3. The base portion 91 is hollow, and is formed with a longitudinally extending second insert groove 911, and has a top surface 912 that inclines downwardly in a direction away from the barrier 93. The barrier 93 is hollow, and is formed with a third insert groove 931 therein. The barrier 93 prevents flow of water from one side of the sliding door unit 3 to the other side of the sliding door unit 3.

Referring again to FIGS. 1 to 3, during assembly, the cylindrical members 41 of each of the slats 4 are extended into an adjacent pair of the engaging grooves 311 of an adjacent pair of the connectors 31 via the access openings 313 in the connectors 31. The upper caps 7, together with the slidable coupling units 75 provided thereon, and the lower caps 8 are fastened to the upper and lower ends of the connectors 31. The rollers 70 of the slidable coupling units 75 are extended into the slide channel 210 via one of the open ends 211 of the slide channel 210. Then, the rail member 2 is fastened to the first and second upright walls 1, 1', and the outer frame member 52 of the connector mounting means 5 and the base portion 91 of the bottom guard member 9 are attached adhesively and respectively to the first upright wall 1 and the raised portion 12 of the ground surface 11. Thereafter, the inner frame member 51 is assembled to the first one of the connectors 31 by extending the tubular member 511 into the adjacent engaging groove 311 in the first one of the connectors 31. The inner frame member 51 is then inserted into the clamping space 524 to engage the outer frame member 52.

In use, fingers can be extended into the finger grooves 336 of the operating frame member 333 for moving the sliding door unit 3 between the unfolded and folded states. As shown, the door unit 3 does not require a relatively large amount of space for movement between the unfolded and folded positions. Moreover, when the door unit 3 is in the folded state, the slats 4 do not contact one another such that water on the surfaces of the slats 4 can easily evaporate to avoid the growth of mildew on the slats 4.

As the slats 4 and the connectors 31 are made of plastic materials, the sliding door unit 3 has a relatively light weight. Thus, movement of the rollers 70 in the slide channel 210 is relatively smooth to facilitate operation of sliding door unit 3, and the rollers 70 can be made of a lower-cost material which is less resistant to deformation to result in more savings and lower price. In addition, assembly and installation of the preferred embodiment can be easily conducted by the consumer without incurring additional costs.

Figure 5:
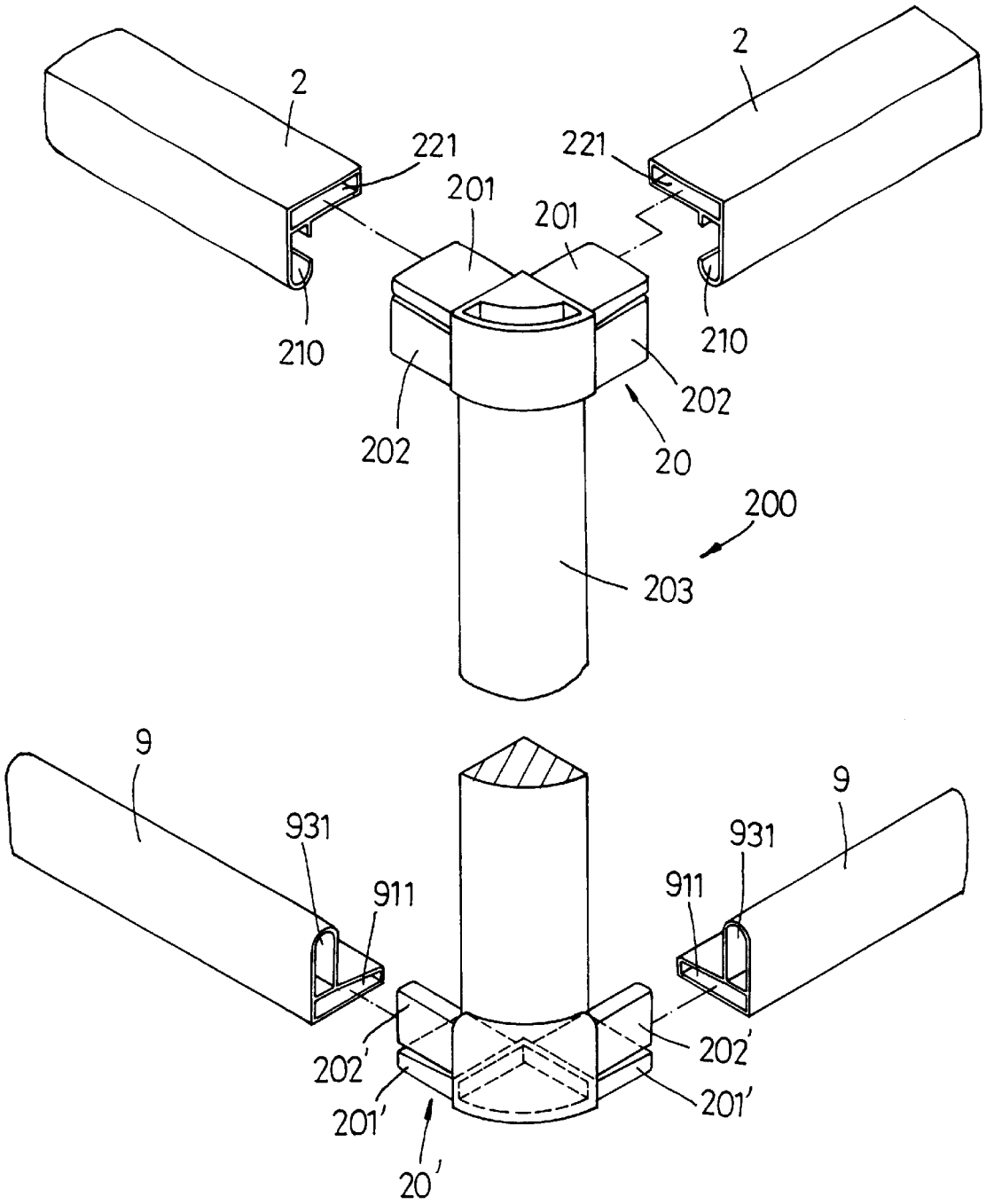
FIG. 5 is a fragmentary perspective view of an alternative arrangement for the preferred embodiment.

Referring to FIG. 5, in an alternative arrangement, a corner unit 200 is provided for interconnecting a pair of the door assemblies which are disposed on different vertical planes that are generally perpendicular. The corner unit 200 includes an upper corner block 20 disposed adjacent to and between the rail members 2 of the door assemblies, a lower corner block 20' disposed adjacent to and between the bottom guard members 9 of the door assemblies, and a strut 203 extending between the upper and lower corner blocks 20, 20' for supporting the upper corner block 20. The upper corner block 20 is formed with a pair of horizontally extending insert members 201 which are inserted into the first insert grooves 221 of the rail members 2, and a pair of vertically extending insert members 202 which are inserted into the slide channels 210 of the rail members 2. The lower corner block 20' is structurally identical to the upper corner block 20, and is invertedly disposed below the upper corner block 20. The horizontally extending insert members 201' of the lower corner block 20' are inserted into the second insert grooves 911 in the base portions 91 of the bottom guard members 9. The vertically extending insert members 202' of the lower corner block 20' are inserted into the third insert grooves 931 in the barriers 93 of the bottom guard members 9. The strut 203 has upper and lower ends inserted into recesses (not shown) formed in the upper and lower corner blocks 20, 20'.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A door assembly adapted for spanning an entrance of a shower room having first and second upright walls that extend upwardly from a horizontal ground surface, said door assembly comprising:

an elongated rail member adapted to be disposed horizontally between the first and second upright walls and to be spaced apart vertically from the ground surface, said rail member being formed with a longitudinally extending slide channel; and a foldable sliding door unit including a plurality of vertically disposed elongated connectors, each of said connectors having an upper end to be disposed adjacent to said rail member, and a lower end to be disposed adjacent to the ground surface, each of said connectors further having left and right sides formed with longitudinally extending left and right engaging grooves, a first one of said connectors being located at one end of said door unit and to be disposed adjacent to the first upright wall, a second one of said connectors being located at the other end of said door unit, connector mounting means adapted for mounting said first one of said connectors on the first upright wall, a plurality of vertically disposed elongated slats, each of said slats having two lateral end portions which are formed respectively with vertically extending cylindrical members, said cylindrical members on each of said slats being received in an adjacent pair of said engaging grooves of an adjacent pair of said connectors such that said cylindrical members are rotatable axially for folding and unfolding of said slats relative to the adjacent pair of said connectors, each of said slats having an upper edge adjacent to said upper ends of said connectors, and a lower edge adjacent to said lower ends of said connectors, and a plurality of slidable coupling units mounted on said upper ends of selected ones of said connectors and extending into and slidable along said slide channel so as to permit movement of said door unit toward the second upright wall to an unfolded state, where said connectors and said slats are disposed on substantially the same vertical plane to close the entrance to the room, and so as to permit movement of said door unit away from the second upright wall to a folded state, where said connectors and said slats cease to be disposed on substantially the same vertical plane to open the entrance to the room.

2. The door assembly according to claim 1, further comprising rail mounting means adapted for mounting opposite ends of said rail member on the first and second upright walls.

3. The door assembly according to claim 1, wherein said connectors are made from a plastic material.

4. The door assembly according to claim 1, wherein said slats are made from a plastic material.

5. The door assembly according to claim 1, wherein said upper and lower ends of each of said connectors are formed with upper and lower access openings for access to said engaging grooves.

6. The door assembly according to claim 1, wherein said door unit further includes a plurality of upper caps fastened to said upper ends of said connectors, respectively.

7. The door assembly according to claim 6, wherein each of said cylindrical members is tubular in shape and has an open top end, each of said upper caps being formed with a pair of positioning posts that extend into said open top ends of said cylindrical members which are received in said elongated grooves of the respective one of said connectors.

8. The door assembly according to claim 6, wherein said slide channel includes a longitudinally extending roller accommodating portion and a longitudinally extending axle slot that is communicated with said roller accommodating portion.

9. The door assembly according to claim 8, wherein said slidable coupling units are provided on respective ones of said upper caps, each of said slidable coupling units including a roller disposed in said roller accommodating portion, an axle having a first end portion connected to said roller and a second end portion that extends out of said roller accommodating portion via said axle slot, and an axle support connected to said second end portion of said axle and to the respective one of said upper caps.

10. The door assembly according to claim 1, wherein said slidable coupling units are mounted on alternating ones of said connectors.

11. The door assembly according to claim 1, wherein said door unit further includes a plurality of lower caps fastened to said lower ends of said connectors, respectively.

12. The door assembly according to claim 11, wherein each of said cylindrical members is tubular in shape and has an open bottom end, each of said lower caps being formed with a pair of positioning posts that extend into said open bottom ends of said cylindrical members which are received in said elongated grooves of the respective one of said connectors.

13. The door assembly according to claim 1, further comprising an elongated bottom guard member adapted to be disposed on the ground surface and to be disposed horizontally between the first and second upright walls, said guard member having a longitudinally extending base portion disposed below said lower edges of said slats and said lower ends of said connectors, and a longitudinally extending barrier that extends upwardly from said base portion and that is disposed on one side of said door unit.

14. The door assembly according to claim 13, wherein said base portion has a top side that inclines downwardly in a direction away from said barrier.

15. The door assembly according to claim 13, wherein said base portion has a bottom side that is adapted to be attached adhesively on the ground surface.

16. The door assembly according to claim 1, wherein said connector mounting means comprises:

an outer frame member adapted to be mounted on the first upright wall and having front and rear clamping portions that define a clamping space therebetween; and an inner frame member clamped within said clamping space and connected to said first one of said connectors.

17. The door assembly according to claim 16, wherein said inner frame member has convex front and rear sides, said front and rear clamping portions having confronting concave faces for engaging said front and rear sides of said inner frame member.

18. The door assembly according to claim 16, wherein said outer frame member is adapted to be attached adhesively on the first upright wall.

19. The door assembly according to claim 1, wherein said door unit further includes an operating frame member connected to said second one of said connectors and operable for moving said door unit between the folded and unfolded states.

20. The door assembly according to claim 19, wherein said operating frame member has front and rear sides which are formed with a respective finger groove to facilitate handling of said operating frame member.

* * * * *